US006938811B2

(12) United States Patent
Ehmig et al.

(10) Patent No.: US 6,938,811 B2
(45) Date of Patent: Sep. 6, 2005

(54) SETTING TOOL

(75) Inventors: Gerhard Ehmig, Rankweil (AT); Tilo Dittrich, Gams (AT)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/858,651

(22) Filed: Jun. 2, 2004

(65) Prior Publication Data

US 2005/0109813 A1 May 26, 2005

(30) Foreign Application Priority Data

Jun. 7, 2003 (DE) ..... 103 25 920

(51) Int. Cl.[7] ..... B25C 1/14
(52) U.S. Cl. ..... 227/10; 227/130
(58) Field of Search ..... 227/9, 10, 11, 227/130; 123/46 SC

(56) References Cited

U.S. PATENT DOCUMENTS 4,721,240 A * 1/1988 Cotta ..... 227/10
4,905,634 A * 3/1990 Veldman ..... 123/46 SC
5,213,247 A * 5/1993 Gschwend et al. ..... 227/10
5,722,170 A * 3/1998 Smith ..... 30/228
5,860,580 A * 1/1999 Velan et al. ..... 227/10
5,909,836 A * 6/1999 Shkolnikov et al. ..... 227/8
6,012,622 A * 1/2000 Weinger et al. ..... 227/8
6,039,229 A * 3/2000 Pfister et al. ..... 227/10
6,053,388 A * 4/2000 Pfister et al. ..... 227/10
6,619,527 B1 * 9/2003 Moeller ..... 227/10

* cited by examiner

*Primary Examiner*—Scott A. Smith
(74) *Attorney, Agent, or Firm*—Abelman, Frayne & Schwab

(57) ABSTRACT

A setting tool for driving in fastening elements includes a drive piston (13) displaceable in a piston guide (11) between its initial (32) and setting positions, and device for returning the drive piston (13) in its initial position upon completion of a setting process and having an electromotive drive (30) and a transmission (20) for transmitting a motive actuating torque to the drive piston (13).

11 Claims, 3 Drawing Sheets

SETTING TOOL

BACKGROUND OF THE INVENTION

1. Field of the Invention

The present invention relates to a setting tool for driving in fastening elements and including a piston guide, a drive piston displaceable in the piston guide between its initial position and its setting position in which the drive piston drives in a fastening element, and a device for returning the drive piston to its initial position after completion of a setting process.

2. Description of the Prior Art

Setting tools of the type described above can be operated with solid, gaseous, or liquid fuels or with compressed air. In combustion-operated setting tools, the setting or drive piston is driven by combustion gases. The setting piston drives a fastening element in a constructional component.

Germani Publication DE 197 55 730 A1 discloses a setting tool having a piston guide in which a drive piston is displaceable. The piston guide itself is also axially displaceable in the tool housing. After completion of a setting process, the drive piston returns to its initial position. In a first step, the drive piston is displaced in a direction opposite the setting direction by an elastic element that was preloaded during the setting process. A further displacement of the piston takes places in a second step during a new press-on process when the bolt guide is displaced in the direction opposite the setting direction relative to the piston guide, entraining the drive piston therewith.

During the return stroke, it can happen that the drive piston would not completely return into its initial position. This is a serious drawback, in particular when during the following setting process, e.g, a nail, a bolt, etc., having a greater length should be driven in a constructional component. Further, the elastic return element is subjected to wear and, therefore, the periods between maintenance are reduced. Still further, return of the piston by the press-process requires application of a greater press-on force by the tool user.

Accordingly, an object of the present invention is to provide a setting tool of the type described above in which the drawbacks of conventional setting tools, e.g., those of DE 197 55 730 A1, are eliminated.

SUMMARY OF THE INVENTION

These and other objects of the present invention, which will become apparent hereinafter, are achieved by providing a setting tool, the drive piston returning device of which includes an electromotive drive and a transmission for transmitting a motive actuation torque to the drive piston. The foregoing novel features of the present invention insure that the drive piston returns into its initial position reliably and without a need to apply an increased press-on force by the tool user. Further, the return of the drive piston in its initial position can be effected continuously and not only stepwise.

Advantageously, the electromotive drive is formed as a d.c. motor. The advantage of a d.c. motor consists in what it can generate a multiple of the return force at an abnormally high resistance to the return movement.

Advantageously, the transmission includes at least one friction wheel engaging the drive piston shaft. With one or several friction wheel(s), the return movement is transmitted to the piston shaft, in an ideal case, by frictional forces. The one or several friction wheel(s) can also assume the function of a piston holder.

Advantageously, the transmission includes a gear unit which is formed in particular as a reducing gear and has its driving side connected with the electromotive drive, and its driven side connected with the at lease one friction wheel. The advantage of the combination friction wheel-gear unit consists in that the gear unit is not damaged by a rapid displacement of the drive piston during the setting process.

It is further advantageous when the one or several friction wheel(s) is/are elastically biased in a direction toward the piston drive shaft. With the friction wheel(s) being biased against the drive piston shaft, an elastic press-on force applied to the drive piston shaft provides for a better holding of the shaft and for compensation of any vibrations.

Advantageously, the one or several friction wheel(s) is/are provided with a support(s) acting in a setting direction and having a counter lock(s) for the drive piston. This insures sliding, during the setting process, of the drive piston shaft relative to the friction wheel(s) which remain or are held stationary. The displacement of the drive piston in the setting direction does not result in actuation of the gear unit or the electromotive drive, which substantially increases their service life.

By the provision of a free-running gear between the gear unit and the friction wheel(s), an action of the drive piston acceleration on the gear unit and the rotor of the electromotive drive during recoil, i.e., rapid return displacement of the drive piston, is prevented.

Advantageously, in the piston guide, there is provided a switch for detecting presence of the drive piston in its initial position. With the provision of the switch, the piston can be returned only over a required return path, which permits to minimize the amount of energy necessary for returning the drive piston to its initial position. The switch reacts very rapidly to the presence of the drive piston in its initial position, which provides for a greater setting frequency. Preferably, the switch is formed as a magnetoresistive sensor.

Advantageously, there is provided an adjustment element having a plurality of driving power positions, and a control unit for controlling the electromotive drive and operatively connected with the adjustment element. The control unit actuates the electromotive drive in accordance with a driving power position selected by a setting tool operator. Thereby, the drive piston is displaced in a setting direction by an amount that provides for driving the drive piston with a predetermined, by the tool operator, driving power. At a maximum driving power, the drive piston is located in its initial position. When the drive piston is to be driven with a smaller driving power, it is displaced, i.e., its initial position is displaced, in the setting direction by a corresponding amount. Thus, the provision of a power selector and a control unit for the drive piston return device permits to regulate the driving power or energy with which the drive piston is driven in the setting direction.

The novel features of the present invention, which are considered as characteristics for the invention, are set forth in the appended claims. The invention itself, however both as to its construction and its mode operation, together with additional advantages and objects thereof, will be best understood from the following detailed description of preferred embodiment, when read with reference to the accompanying drawings.

DETAILED DESCRIPTION OF THE PREFERRED EMBODIMENTS

Figure 1:
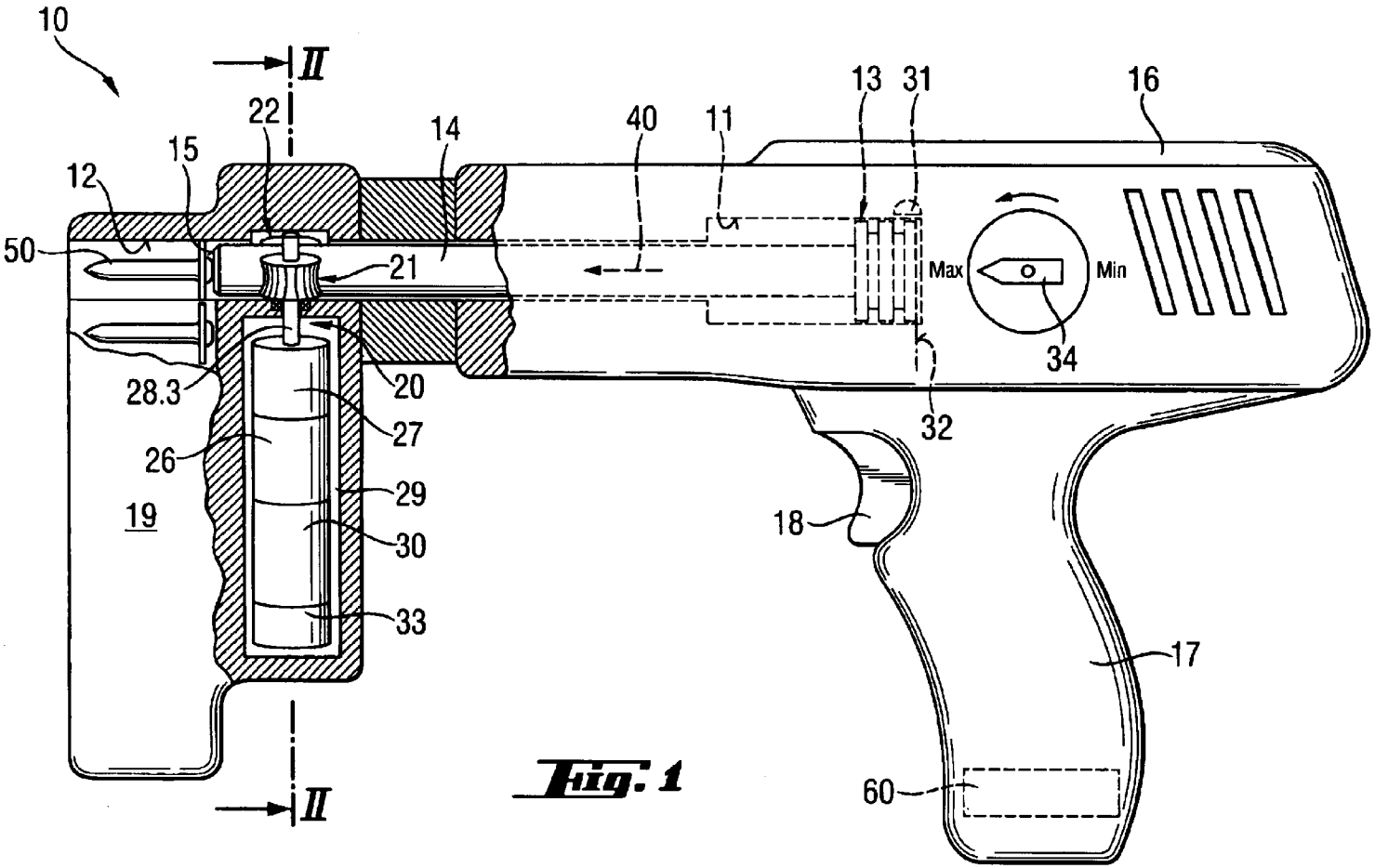
FIG. 1 a side, partially cross-sectional view of a setting tool according to the present invention.

FIGS. 1–4 show a powder charge-operated embodiment of a setting tool according to the present invention. The setting tool 10, which is shown in the drawings, has a housing 16 with a handle 17 provided thereon. An actuation switch 18 for actuating the tool 10 is provided on the handle 17. In the interior of the housing 16, there is provided a piston guide 11 in which a drive piston 13 is axially displaceable. In FIG. 1, the drive piston 13 is shown in its initial position 32 in which it is completely located in the piston guide 11. The drive piston 13 has a piston shaft 14 a setting direction end 15 of which drives a fastening element 50 such as a bolt, nail or the like in a constructional component (not shown).

At the setting direction end of the piston guide 11, there is arranged a bolt guide 12 which includes a cylindrical hollow space through which the drive piston 13 is displaceable.

The setting direction is shown with arrow 40. Before start of a setting process, a fastening element 50 is brought into the bolt guide 12 from a magazine 19 arranged in a region of the bolt guide 12.

After a setting process ends, the drive piston 13 should again be brought into its initial position 32 to again establish the operational readiness of the setting tool 10. To this end, there are provided in the setting tool 10 an electromotive drive 30, which is formed, in the embodiment shown in the drawings, as a d.c. motor, and a transmission means 20. To provide for electrical power supply to the electromotive drive 30 and to other electrical consumers, the setting tool 10 is equipped with a power source such as, e.g., a battery, and accumulator, or a mains connector. The transmission means 20 includes a gear unit 26, e.g., a reducing gear unit which can be flange-mounted on the electromotive drive 30. The gear unit 26 and the electromotive drive 30 are received in a receptacle 29 associated with the magazine 29. Naturally, the gear unit 26 and the electromotive drive 30 can be arranged in another location of the setting tool 10. The gear unit 26 is connected with a power take-off 28.1 downstream of which, a free-running gear 27 is arranged. An axle 28.3, which is supported in a bearing means with a counter lock 25, is attached to the free-running gear 27. A frictional wheel 21 is secured on the axle 28.3. The frictional wheel 21 has an inner cylindrical elastic member 23 and an outer wheel or a wheel rim 24 mounted on the cylindrical elastic member 23. The wheel rim 24 can be formed, e.g., as a friction roller. A second friction wheel 22, identical with the first friction wheel 21, is mounted on the second axle 28.2. The second axle 28.2 is not actively driven but serves as a counter support for the piston shaft 14 which is supported on its opposite side by an actively driven friction wheel 21. The second or a further friction wheel can also be actively driven via the elastic member 23, the friction wheels 21, 22 apply an elastic pressure to the piston shaft 14.

At the end of the piston guide 11, which faces in a direction opposite the setting direction 40, there is provided switch means 31, such as, e.g., a magnetoresistive sensor. With the switch means 31, the electromotive drive 30 can be actuated when the drive piston 13 has left its initial position 32 (with a time delay, if necessary), and deactuated when the drive piston 13 returns to its initial position 32.

Upon initiation of a setting process by the user of the setting tool 10, the drive piston 13 is displaced forward in the setting direction 40 under action of expanding reaction gases. The friction wheels 21, 22 do not rotate by the piston shaft 14 but are statically retained by the bearing means with the counter lock 25. Thus, the forward moving piston shaft 14 of the drive piston 13 slides through the friction wheels 21, 22.

When the drive piston is not driven, it is held in its initial position 32 by frictional forces applied by the friction wheels 21, 22.

After the setting process ends, the drive piston 13 recoils very rapidly to its initial position 32. The free-running gear 27, which is arranged between the friction wheel 21 and the gear unit 26, prevents acceleration of the electromotive drive 30 by the rebounding drive piston 13. This prevents any damage of the rotor of the electromotive drive 30.

After the setting process ends, the switch means 31 actuates, with a time delay, if necessary, the electrical moor means 30 when the switch means 31 does not detect presence of the drive piston 13 in its initial position 32. The rotational movement of the electromotive drive 30 is transmitted to the piston shaft 14 via the gear unit 26, the axle 28, 3, the free-running gear 27, and the friction wheel 21. The torque applied by the piston shaft 14 provides for return of the drive piston 14 to the its initial position 32.

Figure 2:
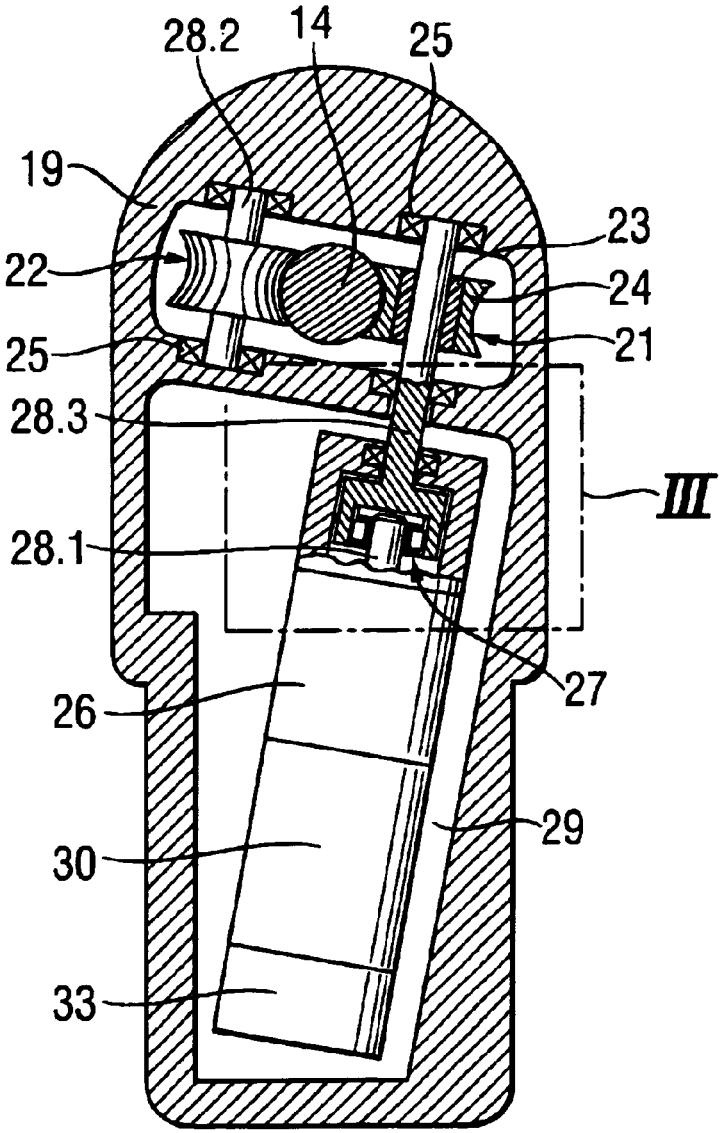
FIG. 2 a cross-sectional view along line II—II in FIG. 1.
Figure 3:
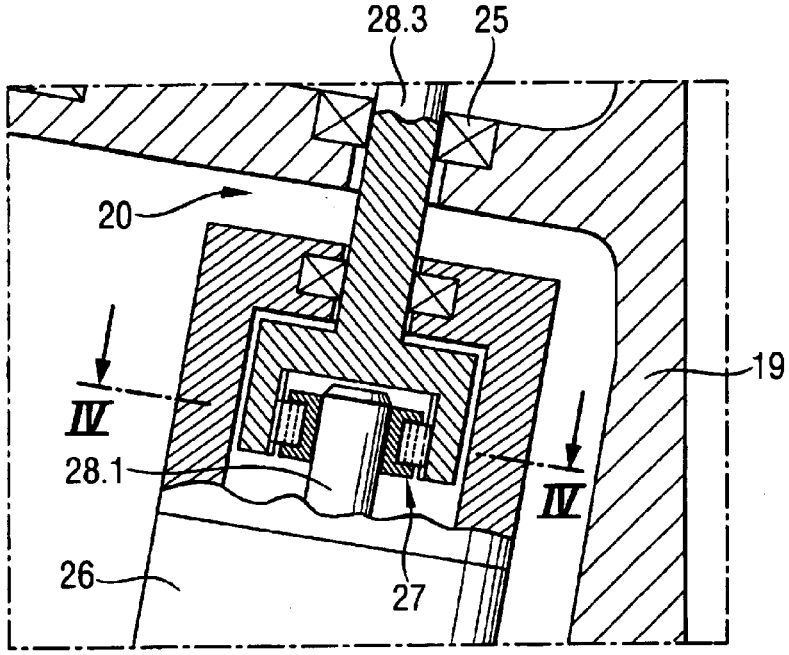
FIG. 3 a cross-sectional view of Section III in FIG. 2 at an increase, in comparison with FIG. 2, scale.
Figure 4:
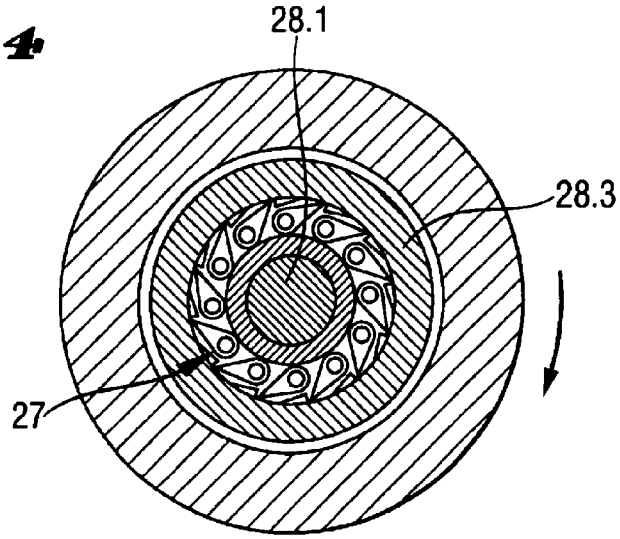
FIG. 4 a cross-sectional view along IV—IV in FIG. 3.

FIGS. 1–2 show an electrical control unit 33 for controlling the electromotive drive 30. The electrical control unit 33 can control the drive energy of the setting tool 10. The adjustment of the drive or setting energy is effected with adjustment means 34 which is formed as a selector switch. E.g., upon the drive piston 13 reaching its initial position 32, the switch means 31 initializes the control unit 33 which, in turn, actuates the electromotive drive 30. The electromotive drive 30 displaces the drive piston 13 in the setting direction 40 by an amount corresponding to a power stage of the adjusting means 34 which was selected by the tool operator. With the displacement of the drive piston 13 in the setting direction 40, a greater combustion volume is provided, and acceleration path of the drive piston 13 becomes reduced, with both resulting in reduction of the setting energy. The maximum power stage of the adjusting means 34 corresponds to the initial position 42 of the drive piston 13.

The electromotive drive 30 and the gear unit 26 are, advantageously, sealed against dust and moisture in order to insure their extended service life and perfect functioning.

The drawings do not show electrical conductors and connections (e.g., a connection of the power source with the switch means, or a power source electromotive drive or switch means electromotive drive) between separate electrical components. It should be understood that such connection exits to enable functioning of the tool.

It is also possible to combine the described above piston return device with a per se known, gas piston return device.

Though the present invention was shown and described with references to the preferred embodiment, such is merely illustrative of the present invention and is not to be construed as a limitation thereof, and various modifications of the present invention will be apparent to those skilled in the art. It is, therefore, not intended that the present invention be limited to the disclosed embodiment or details thereof, and the present invention includes all variations and/or alternative embodiments within the spirit and scope of the present invention as defined by the appended claims.

What is claimed is:

1. A setting tool for driving fastening elements comprising a piston guide (11); a drive piston (13) displaceable in the piston guide (11) between an initial position thereof (32) and a setting position thereof in which the drive piston drives in a fastening element; and means for returning the drive piston (13) in the initial position thereof upon completion of a setting process, the drive piston returning means having an electromotive drive (30) and transmission means (20) for transmitting a motive actuating torque to the drive piston (13).

2. A setting tool according to claim 1, wherein the electromotive drive (30) is formed as a d.c. motor.

3. A setting tool according to claim 1, wherein the transmission means (20) comprises a least one friction wheel (21, 22) engaging a drive shaft (14).

4. A setting tool according to claim 3, wherein the transmission means (20) comprises a gear unit (26) having a drive side thereof connected with the electromotive drive (30), and a driven side thereof connected with the at least one friction wheel (21, 22).

5. A setting tool according to claim 4, further comprising a free-running gear (27) arranged between the gear unit (26) and the at least one friction wheel (21).

6. A setting tool according to claim 3, wherein the at least one friction wheel (21, 22) is elastically biased in a direction toward the drive piston shaft (14).

7. A setting tool according to claim 6, comprising elastic support means for biasing the at least one friction wheel in a direction toward the drive piston shaft (14).

8. A setting tool according to claim 6, wherein the at least one friction wheel (21, 22) is provided with acting in a setting direction (40), support means having a counter lock (25) for the drive piston (13).

9. A setting tool according to claim 1, further comprising switch means (31) provided in the piston guide (11) for detecting presence of the drive piston (13) in the initial position (32) thereof.

10. A setting tool according to claim 9, wherein the switch means (31) is formed as a magnetoresistive sensor.

11. A setting tool according to claim 1, comprising adjustment means (34) having a plurality of driving power positions; and a control unit (33) for controlling the electromotive drive (30) and operatively connected with the adjustment means (34) for actuating the electromotive drive means (30) in accordance with a driving power position selected by a setting tool operator to provide for displacement of the drive piston (13) in a setting direction (40) by an amount that provides for driving the drive piston (13) with a predetermined, by the tool operator, driving power.

* * * * *